US009414674B2

(12) United States Patent
Park et al.

(10) Patent No.: US 9,414,674 B2
(45) Date of Patent: Aug. 16, 2016

(54) AUTOMATIC CLOSING APPARATUS

(71) Applicants: SEGOS CO.,LTD., Incheon (KR); Yoon Sig Park, Seoul (KR)

(72) Inventors: Yoon Sig Park, Seoul (KR); Hyun ho Cha, Gyeonggi-do (KR); Jae Won Kim, Incheon (KR)

(73) Assignees: SEGOS CO., LTD., Incheon (KR); Yoon Sig Park, Seoul (KR)

( * ) Notice: Subject to any disclaimer, the term of this patent is extended or adjusted under 35 U.S.C. 154(b) by 0 days.

(21) Appl. No.: 14/438,578

(22) PCT Filed: Oct. 8, 2013

(86) PCT No.: PCT/KR2013/008978
§ 371 (c)(1),
(2) Date: Apr. 24, 2015

(87) PCT Pub. No.: WO2014/065523
PCT Pub. Date: May 1, 2014

(65) Prior Publication Data

US 2015/0230603 A1 Aug. 20, 2015

(30) Foreign Application Priority Data

Oct. 24, 2012 (KR) ..... 10-2012-0118311

(51) Int. Cl.

| | |
|---|---|
| ***A47B 88/00*** | (2006.01) |
| ***A47B 88/04*** | (2006.01) |
| ***A47B 96/00*** | (2006.01) |
| ***A47B 88/16*** | (2006.01) |

(52) U.S. Cl.
CPC ..... *A47B 88/047* (2013.01); *A47B 88/04* (2013.01); *A47B 88/16* (2013.01); *A47B 96/00* (2013.01)

(58) Field of Classification Search
CPC ..... A47B 88/04; A47B 88/0422; A47B 2210/0054; A47B 2088/0433; A47B 2088/0437; A47B 88/047; A47B 88/16; A47B 96/00
USPC ..... 312/334.4, 334.6
See application file for complete search history.

(56) References Cited

U.S. PATENT DOCUMENTS

| | | | | |
|---|---|---|---|---|
| 5,439,283 | A * | 8/1995 | Schroder et al. | 312/334.4 |
| 5,580,139 | A * | 12/1996 | Grabher | 312/333 |
| 5,588,729 | A * | 12/1996 | Berger | 312/334.4 |
| 6,913,334 | B2 * | 7/2005 | Weichelt | 312/334.4 |
| 7,226,139 | B2 * | 6/2007 | Salice | 312/334.4 |
| 7,549,712 | B2 * | 6/2009 | Booker et al. | 312/334.6 |
| 8,056,994 | B2 * | 11/2011 | Chen et al. | 312/334.6 |
| 8,449,051 | B2 * | 5/2013 | Lam et al. | 312/333 |
| 8,727,460 | B2 * | 5/2014 | Grabher | 312/333 |

(Continued)

FOREIGN PATENT DOCUMENTS

| | | | |
|---|---|---|---|
| JP | 3053935 | U | 9/1998 |
| KR | 10-2004-0042843 | A | 5/2004 |

(Continued)

*Primary Examiner* — Hanh V Tran
(74) *Attorney, Agent, or Firm* — The PL Law Group, PLLC

(57) ABSTRACT

A slide attachment and detachment device for a drawer. The slide attachment and detachment device for a drawer is formed as one member, thereby reducing time and costs consumed for manufacturing the slide attachment and detachment device for the drawer, improving hygienic properties, and enabling use in environments with high humidity.

8 Claims, 8 Drawing Sheets

(56) References Cited

U.S. PATENT DOCUMENTS

| | | | | |
|---|---|---|---|---|
| 8,764,136 | B2 * | 7/2014 | Grabherr | 312/334.4 |
| 8,919,711 | B2 * | 12/2014 | Holzer et al. | 248/201 |
| 8,979,223 | B2 * | 3/2015 | Huang | 312/334.4 |
| 8,991,952 | B2 * | 3/2015 | Salice | 312/334.4 |
| 9,060,604 | B2 * | 6/2015 | Salice | |
| 2008/0265729 | A1 * | 10/2008 | Netzer et al. | 312/330.1 |
| 2009/0236959 | A1 * | 9/2009 | Liang et al. | 312/334.4 |
| 2009/0251037 | A1 * | 10/2009 | Berger | 312/334.1 |

FOREIGN PATENT DOCUMENTS

| | | | |
|---|---|---|---|
| KR | 10-2007-0116962 | A | 12/2007 |
| KR | 10-2012-0113151 | A | 10/2012 |

* cited by examiner

AUTOMATIC CLOSING APPARATUS

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2013/008978, filed Oct. 8, 2013, which claims priority to Korean Patent Application No. 10-2012-0118311, filed July Oct. 24, 2012, the entire contents of which are incorporated herein by reference.

TECHNICAL FIELD

The present invention relates to a slide attachment and detachment device for a drawer that can connect the drawer to a slide intended for guiding pushing or pulling of the drawer or that can separate the drawer from the slide.

BACKGROUND ART

Generally, a receiving means for furniture such as a wardrobe, a cabinet or the like, and electrical appliances such as a refrigerator or the like includes: a drawer in which a storage product can be received; and a receiving body in which the drawer is received, wherein a slide intended for guiding pulling and pushing of the drawer is installed between the drawer and the receiving body so that the drawer can easily open and close.

There may be generated a case where a portion of the drawer is damaged during use of the drawer, and thus components should be replaced, or a case where the drawer should be completely separated from the slide in order to easily arrange products received in the drawer or to clean an inner portion of the drawer.

Meanwhile, when the drawer is large in size, or a storage product received in the drawer is heavy in weight, a load applied to the drawer is increased. In such a case, an undermount slide supporting the load of the drawer from a lower side may be applied.

Due to the reason described above, various types of slide attachment and detachment devices for a drawer intended for connecting the drawer to which the undermount slide is applied to the slide, or separating the drawer from the slide have been researched and developed. As a part thereof, the inventors of the present application have also suggested a relevant technology through Korean Utility Model No. 20-0396803 (Reg. Date: Sep. 20, 2005, Title of the device: Apparatus for adjusting horizontal tilting in drawer).

The slide attachment and detachment devices for a drawer, which have been suggested up to date, use a latch connection structure in which an elastic body is used in the slide attachment and detachment device so that the slide can be easily attached to or detached from the drawer. At this time, in order for the slide to be easily attached to or detached from the drawer, an elastic force of the elastic body should be weak. However, in a case where the elastic body having a weak elastic force is used, when the drawer is pulled at a rapid speed, the drawer pulled by a pulling limitation of the slide, and storage products cause a large impact force on a connecting part of the slide attachment and detachment device due to an inertia force thereof. Due to this, a connection of the slide and the slide attachment and detachment device may be released.

Also, since a plurality of components, including a metal elastic body, is mainly used, an assembly step should be necessarily included in a process for manufacturing the components, so a cost resulting therefrom may be generated. Furthermore, in the slide attachment and detachment devices for a drawer including the metal elastic body, when the drawer is installed in an environment with high humidity and is used for a long time, corrosion is generated from the metal elastic body so that storage products can be contaminated, and elasticity can be reduced. When foreign substances are inserted into a moving portion, the foreign substances can be mixed with the storage products, or the drawer cannot be smoothly attached to or detached from the slide.

SUMMARY

An object of an exemplary embodiment of the present invention is to provide a slide attachment and detachment device for a drawer capable of saving production time and cost consumed for manufacturing the slide attachment and detachment device for the drawer.

Also, another object of the exemplary embodiment of the present invention is to provide a slide attachment and detachment device for a drawer that can be used in environments having high humidity.

Also, a further object of the exemplary embodiment of the present invention is to a slide attachment and detachment device for a drawer in which an elastic support part supports a pulling shock of the drawer and enables an attachment and detachment function to be smoothly performed.

According to an aspect of the present invention, a slide attachment and detachment device for a drawer, which connects the drawer to a slide intended for supporting the drawer and a bottom part of the drawer and for guiding pulling or pushing of the drawer, or which separates the drawer from the slide, may include: a connecting part fixedly connected to at least one selected from a front part and a bottom part of the drawer; a fixation support part formed to protrude from the connecting part in a direction parallel to a pulling or pushing direction of the drawer, and having an operation hole formed to pass through a direction parallel to a direction toward one side of the slide in its central portion when the slide is positioned to support the drawer; an elastic support part formed to protrude from one edge of the operation hole and to cover the operation hole; and a level part formed to extend from an end of the elastic support part, one end of which has a coupling protrusion formed to protrude toward the slide by passing through the operation hole, and the other end of which protrudes in a direction opposite to the coupling protrusion, wherein when an external force parallel to the bottom part of the drawer and toward the slide is applied to the lever part, the elastic support part is elastically changed, so the coupling protrusion is pulled back into the operation hole, and when the external force applied to the lever part is released, the elastic support part is elastically returned, so the coupling protrusion protrudes to an outer portion of the operation hole.

Here, a portion of the elastic support part connected to the fixation support part may be positioned in the pushing direction of the drawer within the operation hole.

Also, a connecting neck having a minimum cross-sectional area may be formed in the elastic support part.

As described above, the slide attachment and detachment device for the drawer further include: an inclination control member connecting groove parallel to the operation hole and having one side opened toward the slide, and formed in the coupling part; an inclination control member slidably movably connected to the inclination control member connecting groove; and a wedge protrusion protruding toward an opening portion of the inclination control member connecting groove, and formed in the inclination control member, wherein the wedge protrusion is interposed between a bottom surface of the drawer and the slide when the slide is positioned to support the drawer, and the inclination control member is slidably moved in a direction toward the slide, so a distance between the bottom surface of the drawer and the slide is extended.

Also, the slide attachment and detachment device for the drawer may further include a shock absorbing part formed to protrude from the coupling part and disposed between the end of the slide and the front part of the drawer when the slide is positioned to support the drawer.

Also, as described above, with regard to the slide attachment and detachment device for the drawer, the connecting part, the fixation support part, the elastic support part, and the lever part may be made of a synthetic resin.

According to an exemplary embodiment of the present invention, a slide attachment and detachment device for a drawer is formed as one member so that time and costs consumed for manufacturing the slide attachment and detachment device for the drawer can be saved, and a moving portion into which foreign substances may be inserted is not formed so that hygienic properties can be improved.

Also, according to the exemplary embodiment of the present invention, a metal elastic body is not included in the slide attachment and detachment device for the drawer, thereby enabling use in environments with high humidity.

Also, according to the exemplary embodiment of the present invention, an elastic support part of the slide attachment and detachment device for the drawer disperses a pulling shock of the drawer as compressive stress so that a connection of the drawer and the slide can be prevented from being unintentionally released, and an attachment and detachment function can be easily performed.

DETAILED DESCRIPTION

Figure 1:
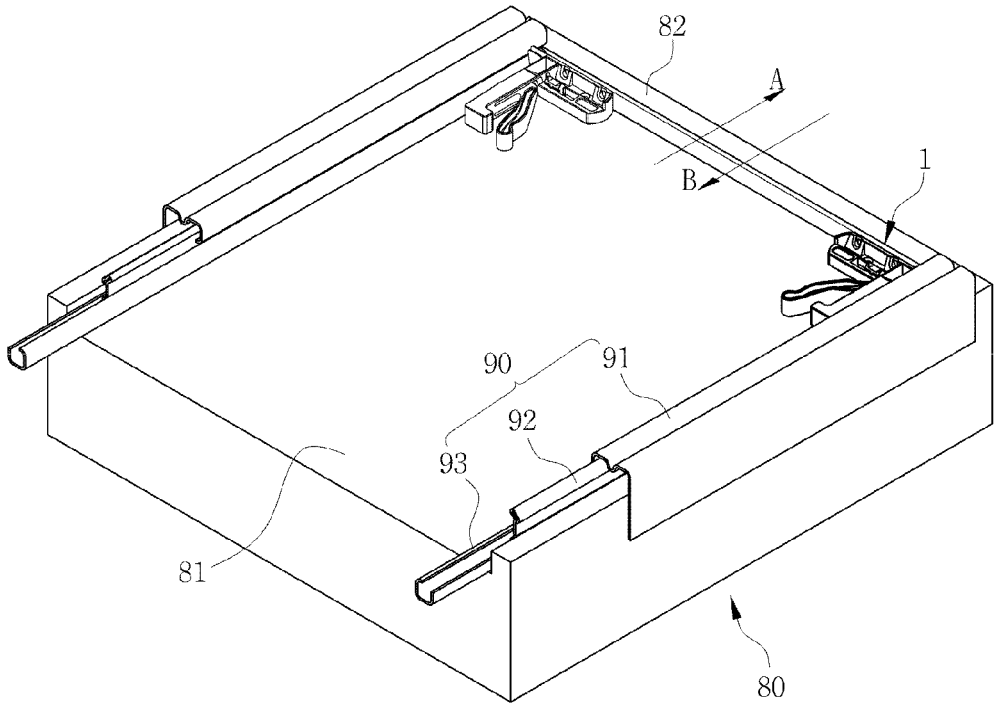
FIG. 1 is a bottom perspective view illustrating an appearance in which a slide attachment and detachment device for a drawer according to one exemplary embodiment of the present invention is connected to the drawer.

Exemplary embodiments of the present invention are capable of various modifications and alternative forms, embodiments of the present invention are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. In the following description, it is to be noted that, when the functions of conventional elements and the detailed description of elements related with the present invention may make the gist of the present invention unclear, a detailed description of those elements will be omitted.

Hereinafter, an exemplary embodiment of the present invention will be descried in detail with reference to the accompanying drawings.

FIG. 1 illustrates an appearance in which a slide attachment and detachment device for a drawer according to one exemplary embodiment of the present invention is connected to the drawer.

Referring to FIG. 1, the slide attachment and detachment device for the drawer 1 according to the one exemplary embodiment is connected to the drawer 80. The slide attachment and detachment device for the drawer 1 is fixedly connected to at least one selected from a bottom part 81 and a front part 82 so that a slide 90 supporting the drawer 80 can be connected to or separated from the drawer 80.

For reference, as previously described, the slide 80 supports the bottom part 81 of the drawer. The slide 80 may include: a fixing rail 91 fixedly connected to a receiving body (not drawn) in which the drawer 80 is received; a moving rail 93 moved along with the drawer 80 upon pulling or pushing the drawer 80 and intended for supporting the bottom part 81 of the drawer 80; and a middle rail 92 slidably movably connected to the fixing rail 91 and the moving rail 93 so that the moving rail 93 can be slidably movable in a pulling direction A or a pushing direction B with respect to the fixing rail 91.

Here, the middle rail 92 is added for extending a pulled distance of the drawer 80, namely, an operating distance of the slide 90, and according to the need, the moving rail 93 may be directly slidably and movably connected to the fixing rail 91.

That is, a slide in other types may be used as the slide 90 as needed. Since this fact is well known, the description of the slide 90 itself is omitted.

For reference, as illustrated, with regard to the slide attachment and detachment device for the drawer 1 according to the one exemplary embodiment, even though a pair of slide attachment and detachment devices for a drawer is generally installed in one drawer 90, since the pair of slide attachment and detachment devices for the drawer 1 is only formed symmetrically and is identical to each other with respect to a structure and an operation thereof, the description of one slide attachment and detachment device for the drawer 1 may replace the description of another one.

Figure 2:
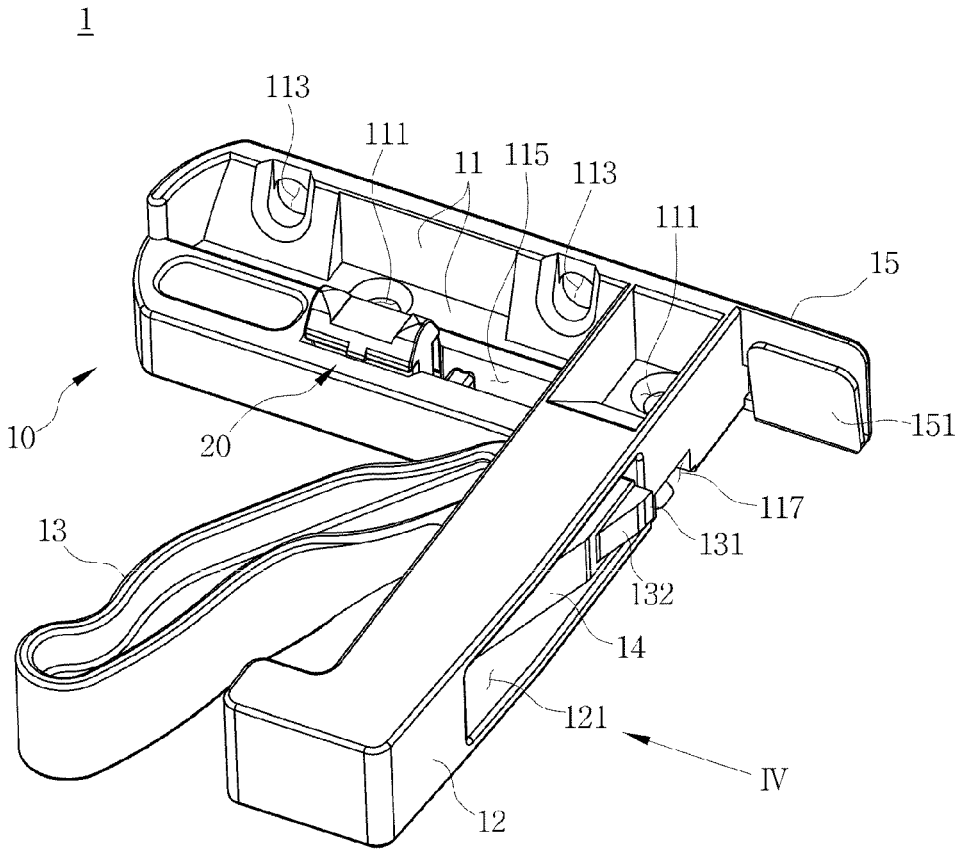
FIG. 2 is a perspective view showing the slide attachment and detachment device for the drawer according to the one exemplary embodiment of the present invention.
Figure 3:
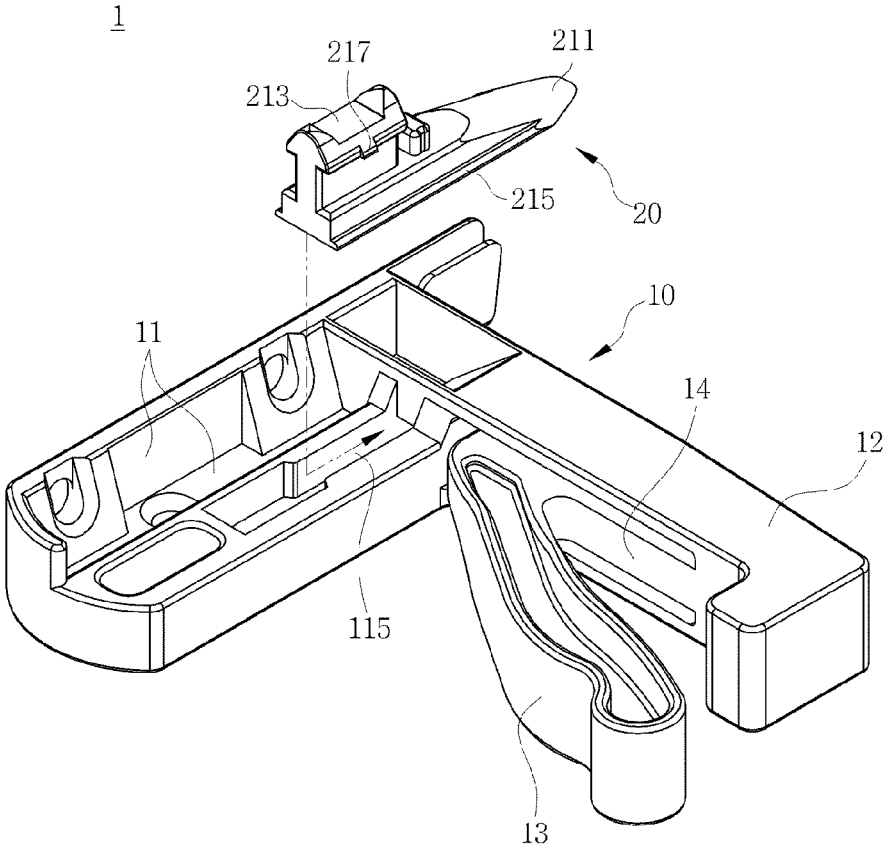
FIG. 3 is an exploded perspective view showing the slide attachment and detachment device for the drawer according to the one exemplary embodiment of the present invention.

FIG. 2 is a perspective view showing the slide attachment and detachment device for the drawer according to the one exemplary embodiment of the present invention, and FIG. 3 is an exploded perspective view showing the slide attachment and detachment device for the drawer according to the one exemplary embodiment of the present invention. The slide attachment and detachment device for the drawer will be described with reference to FIGS. 2 and 3.

Referring to FIGS. 2 and 3, the slide attachment and detachment device for the drawer 1 according to the one exemplary embodiment of the present invention includes a main body 10 and an inclination control member 20.

The main body 10 may include a connecting part 11, a fixation support part 12, a lever part 13, an elastic support part 14, and a shock absorbing part 15.

The connecting part 11 is fixed to at least one selected from the bottom part (reference numeral 81 of FIG. 1) and the front part (reference numeral 82 of FIG. 1) of the drawer (reference numeral 80 of FIG. 1). As illustrated, the connecting part may be formed to be simultaneously adhered to the bottom part 81 and the front part 82, and a bottom connecting hole 111 and a front connecting hole 113 may be formed in the connecting part 11.

A coupling member, such as a screw not illustrated, is inserted into the bottom connecting hole 111 and the front connecting hole 113 to be connected to at least one selected from the bottom part 81 and the front part 82 so that the connecting part 11 can be fixedly connected to at least one selected from the bottom part 81 and the front part 82.

The fixation support part 12 is formed to protrude from the connecting part 11. The fixation support part 12 is shaped to protrude in a direction parallel to a pulling direction (A of FIG. 1) and a pushing direction (B of FIG. 1) of the drawer 80.

An operating hole 121 is formed in a middle portion of the fixation support part 12. As illustrated in FIG. 1, when the moving rail 93 of the slide (reference numeral 90 of FIG. 1) is positioned to support the bottom part 81 of the drawer 80, the operating hole 121 may be formed in the fixation support part 12 in a direction parallel to a direction toward one side of the moving rail and an opposite direction of the direction. That is, the operating hole 121 may be formed on a virtual plane parallel to the bottom part 81 in a direction vertical to the moving rail 93.

For reference, the terms 'parallel to' and 'vertical' mean 'parallel to' and 'vertical' in consideration of a processing error and the like rather than 'parallel to' and 'vertical' in terms of mathematics.

The elastic support part 14 may be formed to protrude from one edge of the operating hole 121 and may be shaped to cover the operating hole 121. The shape of the elastic support part 14 will be described with reference to FIGS. 4 and 5.

Figure 4:
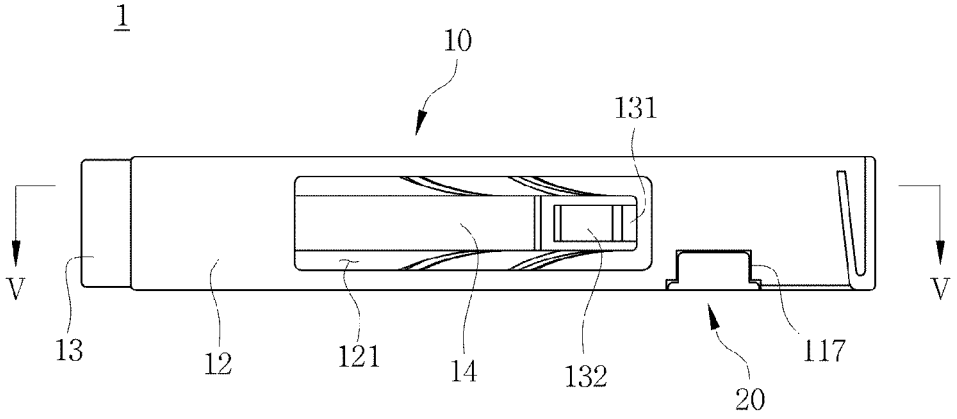
FIG. 4 is a side view illustrating an appearance of the slide attachment and detachment device for the drawer as viewed from direction IV.
Figure 5:
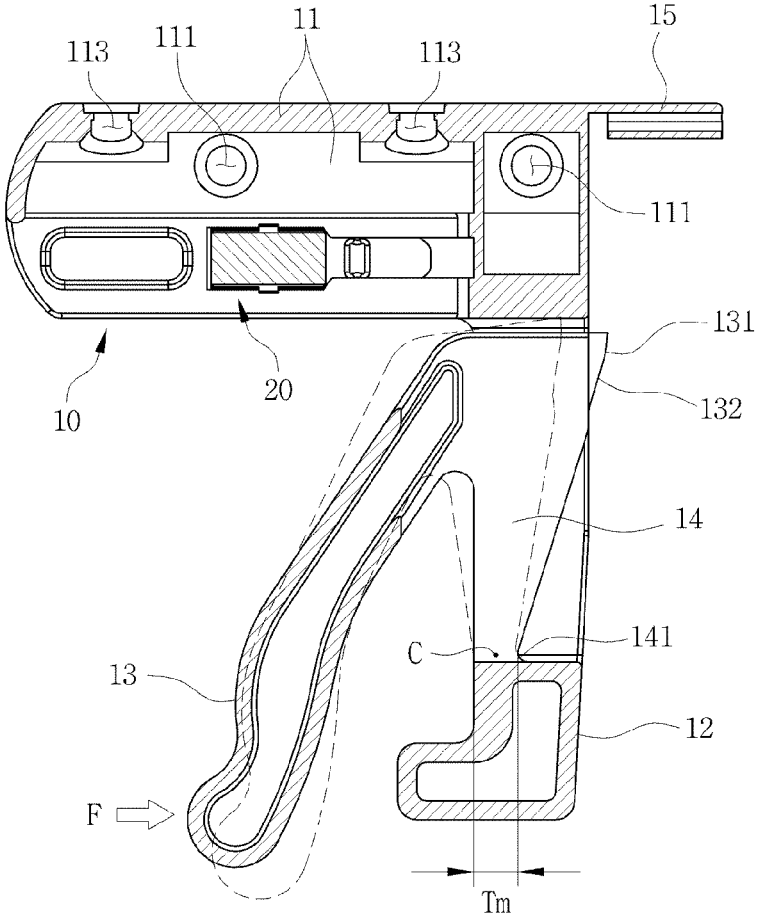
FIG. 5 is a cross-sectional view taken along straight line V-V indicated in FIG. 4.

FIG. 4 is a side view illustrating the shape of the elastic support part as viewed from direction IV indicated in FIG. 2, and FIG. 5 illustrates a cross-sectional view taken along straight line V-V indicated in FIG. 4.

Referring to FIGS. 4 and 5, the elastic support part 14 is formed to protrude from one edge of the operating hole 121 of the fixation support part 12 and is formed to cover the operating hole 121, and a remaining portion except for a portion connected to the fixation support part 12 is separated from the other edge of the operating hole 121.

Here, as illustrated, the portion of the elastic support part 14 connected to the fixation support part 12 may be positioned in the operating hole 121 in the pushing (B) direction of the drawer.

Referring to FIGS. 2 and 3 again, the lever part 13 is protrudly formed at the end of the elastic support part 14, namely, at the best protruding portion from the fixation support part 12 in a portion which is not connected to the fixation support part 12.

As illustrated, based on the fixation support part 12, the lever part 13 protrudes in a direction opposite to a portion in which the moving rail 93 is disposed. At this time, the lever part 13 protrudes to a space between a direction parallel to the fixation support part 12 and a direction parallel to the operating hole 121. The fixation support part 12 and the lever part 13 may form a fixed angle. Such an angle may be designed so that a user can easily grasp the lever part 13.

A coupling protrusion 131 protruding in a direction toward the moving rail 93 by passing through the operating hole 121 may be formed in one end of both ends of the lever part 13, the one end being disposed on a side at which the operating hole 121 is positioned. A guide surface 132 may be formed on the coupling protrusion 131. As illustrated, the guide surface 132 may be shaped to be inclined in a direction far away from the moving rail 93 as the guide surface becomes close from the end of the coupling protrusion 131 to the pushing (B) direction of the drawer 80 gradually.

Accordingly, the coupling protrusion 131 protrudes roughly in a direction opposite to an extending direction of the lever part 13. Each operation of the lever part 13, the coupling protrusion 131 and the elastic support part 14 will be described later again.

The shock absorbing part 15 is formed to protrude from the connecting part 11. As illustrated in FIG. 1, when the moving rail 93 of the slide 90 is positioned to support the drawer 80, the shock absorbing part 15 is formed to be interposed between an end of the moving rail 93 and the front part front 82.

A shock absorbing piece 151 is protrudly formed in the shock absorbing part 15. The shock absorbing piece 151 is formed so as to absorb a shock generated from between the front part 82 of the drawer 80 and the end of the moving rail 93. The operation of the shock absorbing part 15 will be described later again.

Meanwhile, an inclination control member connecting groove 115 to which the inclination control member 20 is slidably movably connected is formed in the connecting part 11. The inclination control member connecting groove 115 is formed in a direction parallel to the operating hole 121 as illustrated, a wedge protrusion projecting groove 117 opened in a direction at which the moving rail 93 is disposed is formed to extend on one side of the inclination control member connecting groove 115.

A wedge protrusion 211, a knob 213, a guide protrusion 215, and a supporting protrusion 217 are formed in the inclination control member 20.

The wedge protrusion 211 is formed to protrude in a direction toward the wedge protrusion projecting groove 117 when the inclination control member 20 is connected to the inclination control member connecting groove 115. A portion of the wedge protrusion in which the wedge protrusion projecting groove 117 is in contact with the bottom part 81 may be formed to have a plan shape, and the remaining portion except for the portion may have inclined surface-like shape so that a thickness of the wedge protrusion 211 can be gradually reduced toward a protruding direction of the wedge protrusion 211.

The guide protrusion 215 may be formed in a direction parallel to a direction in which the inclination control member 20 connected to the inclination control member connecting groove 115 is slidably moved. The guide protrusion 215 may enable the inclination control member 20 connected to the inclination control member connecting groove 115 to be smoothly slidably moved along the inclination control member connecting groove 115.

That is, a guide groove (not drawn) having a shape corresponding to the guide protrusion 215 is formed in the inclination control member connecting groove 115. The guide protrusion 215 is inserted into and supported by the guide groove (not drawn) so that sliding movement according to the inclination control member connecting groove 115 of the inclination control member 20 can be guided.

The knob 213 is a portion intended for enabling the inclination control member 20 to be slidably moved along the inclination control member connecting groove 115. The knob 213 may be shaped to protrude in a fixed height from the bottom part 81 to a lower side of the drawer 80, and at least one groove, protrusion, or the like may be formed at an end of the knob 213 so that a user can easily apply a force to the know with his or her finger.

Accordingly, as the user applies the force to the knob 213, when the inclination control member 20 is slidably moved to the direction at which the moving rail 93 is disposed, namely, the inclination control member is slidably moved toward the protruding direction of the wedge protrusion 211, the wedge protrusion 211 protrudes to the outside via the wedge protrusion projecting groove 117. Also, when the inclination control member 20 is slidably moved in an opposite direction thereof, the wedge protrusion 211 may be pulled back into the wedge protrusion projecting groove 117.

The supporting protrusion 217 functions to support the inclination control member 20 so that the inclination control member 20 cannot be separated from the inclination control member connecting groove 115. That is, the supporting protrusion 217 prevents the inclination control member 20 from being separated from the main body 10 during a process for connecting the slide attachment and detachment device for the drawer 1 to the drawer 80.

To do so, the supporting protrusion 217 is formed to further protrude to both sides than a width formed between both sides of the inclination control member connecting groove 115 so that the inclination control member 20 can be supported by the supporting protrusion 217, as well as the guide protrusion 215 after the inclination control member 20 has been connected to the inclination control member connecting groove 115. As a result, the inclination control member 20 can be prevented from being separated from the main body 10.

Each operation of the lever part 13, the coupling protrusion 131, and the elastic support part 14 will be described with reference to FIG. 5 again.

Referring to FIG. 5, a modified appearance of the elastic support part 14 resulting from applying an external force F to the lever part is indicated by a dotted line. That is, as illustrated, when the external force F is applied to the lever part 13 in a direction parallel to the bottom part 81 of the drawer, and toward the moving rail 93 of the slide from the fixation support part 12, the external force F is transmitted to the elastic support part 14 via the lever part so that the elastic support part 14 can be elastically modified.

At this time, in order for the elastic support part 14 to be elastically modified as indicated by the dotted line, the elastic support part 14 may have smaller flexural rigidity than that of the lever part 13.

Also, in order to minimize a change in a position of the lever part 13 generated when the coupling protrusion 131 is pulled back into the operating hole (reference numeral 121 of FIG. 2) according to the elastic modification of the elastic support part 14, the elastic modification of the elastic support part 14 may be mainly generated from a portion connected to the fixation support part 12. To do so, as illustrated, a connecting neck 141 may be formed in the elastic support part 14.

As previously described, the connecting neck 141 is a portion from which the largest elastic modification is generated when the external force F is applied to the lever part 13. The connecting neck 141 may be formed to have a small cross-sectional area compared to different portions of the elastic support part 14. In such a case, when the external force F is applied to the lever part 13, the connecting neck 141 is elastically modified based on a portion C of the connecting neck 141 having a minimum cross-sectional area so that a position of the lever part 13 and a position of the elastic support part 14 can be changed in a shape resulting from being rotated with respect to the fixation support part 12.

For reference, Tm corresponding to a sign, which is not described, represents a width of the portion C of the connecting neck 141 having the minimum cross-sectional area. For manufacturing convenience of the elastic support part 14, a portion C having a minimum cross-sectional area may be formed in the connecting neck 141 in such a manner that a thickness of the elastic support part 14 is regularly formed, and a minimum width Tm is formed in the connecting neck 141.

Meanwhile, when the external force F applied to the lever part 13 is released, the connecting neck 141, which has been elastically modified, is elastically returned to a position before the external force F is applied. Accordingly, the positions of the remaining portions of the lever part 13 and the elastic support part 14 are also returned, so that the coupling protrusion 131 protrudes to the outside of the operating hole 121.

As previously described, the main body of the slide attachment and detachment device for the drawer 1 according to the one exemplary embodiment is formed in integral form. At this time, in order for the connecting neck 141 of the elastic support part 14 to be elastically modified by the external force F or to be returned to its original position according to release of the external force and to have enough strength to prevent from being damaged during using it, the main body should be made of a material having high strength and sufficient elasticity.

Examples of the material having these properties include, but not is limited to, synthetic resin having high strength, fatigue resistance, hardness, wear resistance, and the like, such as polyoxymethylene, poly acetal and ABS resin, nylon, and the like.

When the process for applying the external force F to the lever part 13 or for releasing the external force from the lever part is repeated, tensile stress and compressive stress are repeatedly applied to the connecting neck 141 of the elastic support part 14. When the tensile stress and the compressive stress is intensively applied to a specific portion of the connecting neck 141, a lifespan of the connecting neck 141 may be reduced.

In order to prevent this, the connecting neck 141 may be shaped such that the tensile stress and the compressive stress are dispersively operated. That is, an outline of the elastic support part 14 including the connecting neck 141 may have a flexible curved shape in which a vertex is not formed between a portion of the elastic support part connected to the fixation support part 12 and a portion of the elastic support part connected to the lever part 13.

An operation of the slide attachment and detachment device for the drawer 1 according to the one exemplary embodiment of the present invention having the structure as described above will be hereinafter described with reference to FIGS. 6 to 8.

Figure 6:
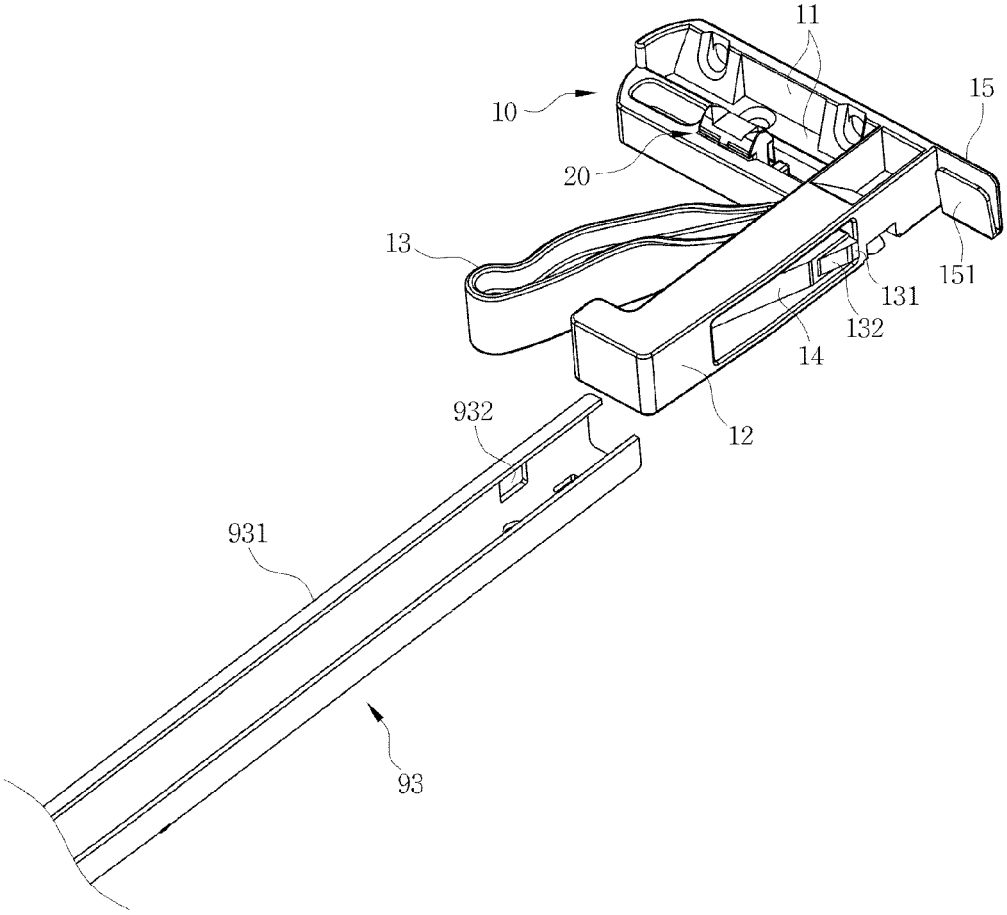
FIGS. 6 and 7 are perspective views illustrated for describing an operation of the slide attachment and detachment device for the drawer according to the one exemplary embodiment of the present invention.
Figure 7:
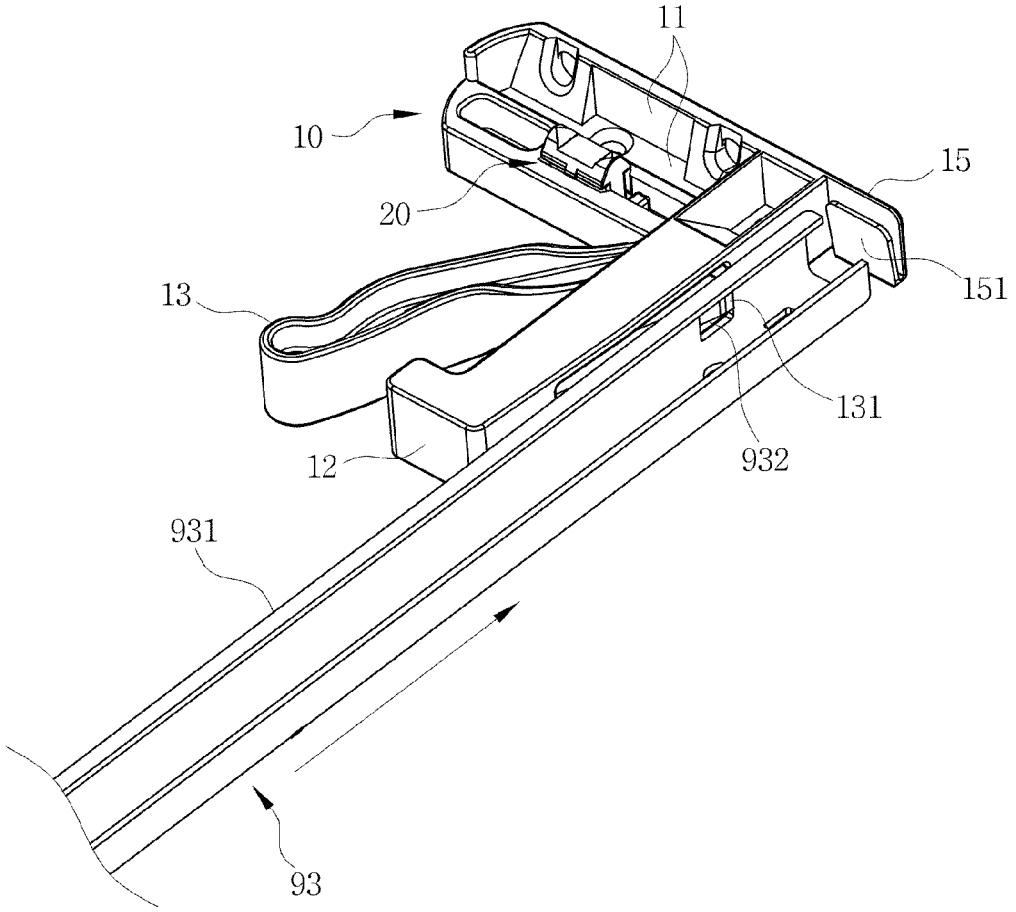

FIGS. 6 and 7 illustrate perspective views for explaining the operation of the slide attachment and detachment device for the drawer 1 according to the one exemplary embodiment of the present invention. The operation will be described with reference to FIG. 1, as well as these drawings.

Referring to FIGS. 6 and 7, the main body 10 of the slide attachment and detachment device for a drawer 1 according to the one exemplary embodiment of the present invention, and the moving rail 93 are illustrated. For convenience, in FIGS. 6 and 7, the drawer 80 is not illustrated.

The moving rail 93 includes a moving rail body 931. As illustrated, a coupling hole 932 is formed in the moving rail body 931. The coupling hole 932 may be formed at a position corresponding to the coupling protrusion 131.

In order for the moving rail 93 to support the bottom part 81 of the drawer 80, one side of the moving rail 93 is coupled to the main body 10 by moving the moving rail from a position in the state illustrated in FIG. 6 to a position in the state illustrated in FIG. 7.

In such a process, when the end of the moving rail body 931 is moved toward the shock absorbing part 15, the coupling protrusion 131 in a state of further protruding than the fixation support part 12 is in contact with the moving rail body 931.

At this time, as the end of the moving rail body 931 is moved toward the shock absorbing part 15 by a shape of the guide surface 132, a force toward an inner direction of the operating hole (reference numeral 121 of FIG. 2) is applied to the coupling protrusion 131. Due to this force, the connecting neck 141 is elastically modified, the coupling protrusion 131 is pulled back into the operating hole 121.

Then, the moving rail body 931 is further moved toward the shock absorbing part 15, so when the coupling hole 932 is positioned at the coupling protrusion 131, the force applied to the coupling protrusion 131 is released. Thus, while the connecting neck 141 is elastically returned, the coupling protrusion 131 protrudes to the outside of the operating hole 121 again. Accordingly, the coupling protrusion 131 is inserted into the coupling hole 932, and accordingly, the main body 10 is coupled to the moving rail body 931.

As such, after the main body 10 and the moving rail body 931 have been coupled to each other, when the user applies a force A to the drawer 80 in a pulling direction of the drawer, an edge of the coupling hole 932 is supported by an opposite portion of a portion in which the guide surface 132 of the coupling protrusion 131 is formed so that the coupling protrusion 131 can be maintained in a state of being coupled to the coupling hole 932. When the user applies a force to the drawer in a pushing direction B of the drawer, an end of the moving rail body 931 is pressurized by the front part 82 of the drawer 80 so that the coupling protrusion 131 can be maintained in a state of being coupled to the coupling hole 932.

Accordingly, when the drawer 80 is pulled (A) or pushed (B) after the coupling protrusion 131 has been coupled to the coupling hole 932, the main body 10 and the moving rail 93 are maintained in a state of being coupled so that pulling (A) and pushing (B) of the drawer 80 can be guided by the slide 90.

At this time, the shock absorbing part 15 is interposed between the end of the moving rail 93 and the front part 82 of the drawer 80. The end of the moving rail 93 and the front part 82 of the drawer are elastically supported by the shock absorbing piece (reference numeral 151 of FIG. 2) in a spaced direction between the end of the moving rail and the front part.

This is intended to constantly bring an edge of the coupling hole 932 into contact with the coupling protrusion 131 when the coupling protrusion 131 is coupled to the coupling hole 932. Thus, a stable coupling state of the coupling protrusion 131 and the coupling hole 932 is maintained so that noise resulting from movement of the coupling protrusion 131 in the coupling hole 932 can be prevented from being generated, or movement of the drawer 80 with respect to the moving rail 93 can be prevented from being generated.

Also, when the user stops his or her action in the middle of pulling (A) the drawer 80 at a rapid speed, or the user pushes (B) the drawer 80 strongly, the end of the moving rail 93 may collide with the front part 82 due to an inertia force generated by movement of the moving rail 93. Thus, the shock absorbing piece 151 of the shock absorbing part 15 interposed between the end of the moving rail 93 and the front part 82 is compressed and modified so as to absorb an impulsive force.

As such, the shock absorbing part 15 may enable the slide attachment and detachment device for the drawer 1 and the moving rail 93 to be stably coupled, may prevent the occurrence of noise upon pulling (A) or pushing the drawer 80, and may enable the extension of a lifespan by absorbing an impact applied to the drawer 80 and the moving rail 93.

Meanwhile, as previously described, when the drawer 80 is separated from the slide 90, the user takes a motion to pull (A) the drawer 80, and thereafter, he or she grasps both sides of the drawer 80 with both hands and holds the lever part 13 with fingers to apply a force (see F of FIG. 5) so that the coupling protrusion 131 can be pulled back into the operating hole 121, and thus can be separated from the coupling hole 932, thereby enabling the main body 10 to be separated from the slide 90.

Furthermore, when the drawer 80 is connected to the slide 90, the bottom part 81 of the drawer 80 is mounted on the moving rail 93, and thereafter, the drawer 80 is moved in the pushing (B) direction so that the moving rail body 931 can be relatively moved with respect to the main body 10 as illustrated in FIGS. 6 and 7, and as a result, the coupling protrusion 131 can be coupled to the coupling hole 932.

For reference, in order to prevent a pain or an inconvenient touch sensation from being generated from the lever part when the user applies a force to the lever part 13, a finger-shaped groove may be formed in the lever part 13.

Figure 8:
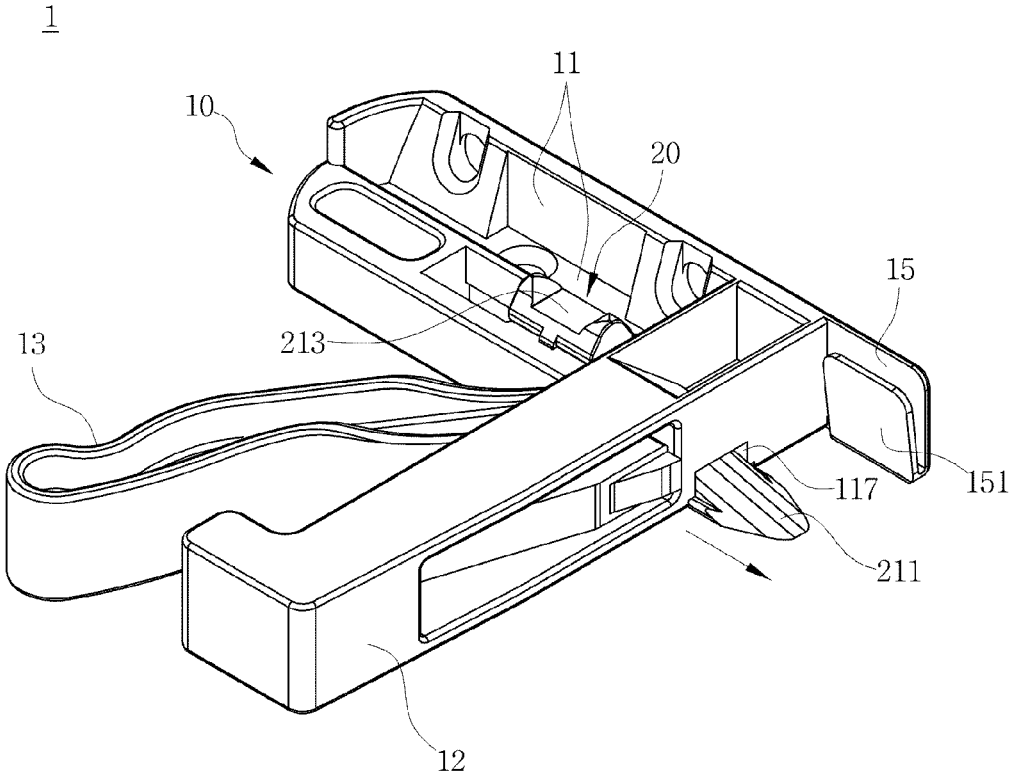
FIG. 8 is a perspective view illustrated for describing an operation of an inclination control member of the slide attachment and detachment device for the drawer according to the one exemplary embodiment of the present invention.

FIG. 8 is a perspective view illustrated for describing an operation of an inclination control member of the slide attachment and detachment device for the drawer according to the one exemplary embodiment of the present invention.

Referring to FIG. 8, the inclination control member 20 is slidably moved in a direction toward the moving rail 93 so that the wedge protrusion 211 can protrude through the wedge protrusion projecting groove 117. The operation of the inclination control member will be described with reference to FIG. 1, as well as FIG. 8.

A tolerance resulting from a processing error and the like may be generated between the drawer 80, the slide 90, and a receiving body (not drawn) during a process for connecting the drawer 80 to the receiving body (not drawn).

For example, with respect to a connection angle of the bottom part 81 and the front part 82 corresponding to constitutive elements of the drawer 80, a position in which the fixing rail 91 is fixed to an inner side of the receiving body (not drawn), a relative portion between the fixing rail 91 and the moving rail 93, and the like, a fine tolerance may be generated.

Accordingly, during a process for assembling the drawer 80 with the receiving body (not drawn), the front part 82 may form a slope in a specific direction due to the tolerance as described above.

In such a case, since the front part 82 causes interference with a front part of another drawer which is not illustrated, pulling (A) and pushing (B) may not be smoothly performed, or noise may be generated. Also, since an arrangement state of the front part 82 is not regular, the appearance of a receiving means (not drawn) may not be beautiful.

At this time, an angle and a balance of the front part 82 may be amended by adjusting a position of the inclination control member 20.

That is, as the inclination control member 20 is slidably moved toward the slide 90, the wedge protrusion 211 protrudes to the outside of the wedge protrusion projecting groove 117. The protruding wedge protrusion 211 is interposed between the bottom part 81 of the drawer 89 and the moving rail 93. Accordingly, a distance between the bottom part 81 and the moving rail 93 may be extended. Here, since a level of the extension of the distance between the bottom part 81 and the moving rail 93 is relative to a protruding level of the wedge protrusion 211, the level of the extension of the distance described above may be adjusted by adjusting a sliding level of the inclination control member 20 performed toward the slide 90.

Meanwhile, as described above, since the inclination control member 20 is slidably moved to an appropriate position, after an angle and a balance state of the front part 82 have been adjusted, such a state should be maintained.

Accordingly, even though it is not illustrated, a plurality of unevennesses is formed in any one of the guide protrusion 215 and the guide groove (not drawn) along a lengthwise direction, and unevennesses corresponding thereto are also formed in another one so that the inclination control member 20 can be fixed at a position set by the user, and thus can be prevented from being arbitrarily moved. Also, a plurality of supporting grooves (not drawn) having a shape corresponding to the supporting protrusion 217 may be formed in a direction parallel to a direction at which the inclination control member 20 is slidably moved along both sides of the inclination control member connecting groove 115.

As described above, in the slide attachment and detachment device for the drawer 1 according to the one exemplary embodiment of the present invention, since the main body 10 may be formed as one member, namely, may be formed in an integral form, the time and costs consumed for manufacturing the slide attachment and detachment device for the drawer 1 can be saved.

Furthermore, as described above, since the main body 10 is formed in the integral form, a moving portion into which foreign substances may be inserted is not formed so that hygienic properties can be improved. Accordingly, the slide attachment and detachment device for the drawer 1 according to the one exemplary embodiment of the present invention can be stably used even in devices for which hygienic properties are required, such as a refrigerator and the like.

Also, since a separate metal elastic body and the like are not included, and there is no possibility that the main body 10 itself will corrode, the slide attachment and detachment device for the drawer can be used even in environments having high humidity.

Although the slide attachment and detachment device for the drawer according to the exemplary embodiment of the present invention has been described, an idea of the present invention should not be limited to the exemplary embodiment presented in the specification, and those skilled in the art who understand the idea of the present invention will appreciate that other exemplary embodiments by various additions, modifications, deletions and substitutions of the constitutive elements can be easily suggested, without departing from the scope and spirit of the invention as disclosed in the accompanying claims.

<Description of the Reference Numerals>

| | |
|---|---|
| 1: Slide attachment and detachment device for a drawer | |
| 10: Main body | |
| 11: Connecting part | 111: Bottom connecting hole |
| 115: Inclination control member connecting groove | |
| 117: Wedge protrusion projecting groove | |
| 12: Fixation support part | 121: Operating hole |
| 13: Lever part | 131: Coupling protrusion |
| 132: Guide surface | 14: Elastic support part |
| 141: Connecting neck | 15: Shock absorbing part |
| 151: Shock absorbing piece | |
| 20: Inclination control member | |
| 211: Wedge protrusion | 213: Knob |
| 215: Guide protrusion | 217: Supporting protrusion |

-continued

<Description of the Reference Numerals>

| | |
|---|---|
| 80: Drawer | 81: Bottom part |
| 82: Front part | 90: Slide |
| 91: Fixing rail | 92: Middle rail |
| 93: Moving rail | 931: Moving rail body |
| 932: Coupling hole | |

The invention claimed is:

1. A slide attachment and detachment device for a drawer, which connects the drawer to a slide intended for supporting the drawer and a bottom part of the drawer and for guiding pulling or pushing of the drawer, or which separates the drawer from the slide, the slide attachment and detachment device, comprising:

a connecting part fixedly connected to at least one selected from a front part and a bottom part of the drawer;

a fixation support part formed to protrude from the connecting part in a direction parallel to a pulling or pushing direction of the drawer, and having an operation hole formed to pass through a direction parallel to a direction toward one side of the slide in its central portion when the slide is positioned to support the drawer;

an elastic support part formed to protrude from one edge of the operation hole and to cover the operation hole; and a lever part formed to extend from an end of the elastic support part, one end of which has a coupling protrusion formed to protrude toward the slide by passing through the operation hole, and the other end of which protrudes in a direction opposite to the coupling protrusion, wherein a connecting neck having a minimum cross-sectional area is formed in the elastic support part, and the elastic support part have smaller flexural rigidity than that of the lever part, and wherein when an external force parallel to the bottom part of the drawer and toward the slide is applied to the lever part, the connecting neck of the elastic support part is elastically changed, so the coupling protrusion is pulled back into the operation hole, and when the external force applied to the lever part is released, the connecting neck of the elastic support part is elastically returned, so the coupling protrusion protrudes to an outer portion of the operation hole.

2. The slide attachment and detachment device of claim 1, wherein a portion of the elastic support part connected to the fixation support part is positioned in the pushing direction of the drawer within the operation hole.

3. The slide attachment and detachment device of claim 1, further comprising: an inclination control member connecting groove parallel to the operation hole and having one side opened toward the slide, and formed in the coupling part; an inclination control member slidably movably connected to the inclination control member connecting groove; and a wedge protrusion protruding toward an opening portion of the inclination control member connecting groove, and formed in the inclination control member, wherein the wedge protrusion is interposed between a bottom surface of the drawer and the slide when the slide is positioned to support the drawer, and the inclination control member is slidably moved in a direction toward the slide, so a distance between the bottom surface of the drawer and the slide is extended.

4. The slide attachment and detachment device of claim 1, further comprising a shock absorbing part formed to protrude from the coupling part and disposed between the end of the slide and the front part of the drawer when the slide is positioned to support the drawer.

5. The slide attachment and detachment device of claim 1, wherein the connecting part, the fixation support part, the elastic support part, and the lever part are made of a synthetic resin.

6. The slide attachment and detachment device of claim 2, further comprising: an inclination control member connecting groove parallel to the operation hole and having one side opened toward the slide, and formed in the coupling part; an inclination control member slidably movably connected to the inclination control member connecting groove; and a wedge protrusion protruding toward an opening portion of the inclination control member connecting groove, and formed in the inclination control member, wherein the wedge protrusion is interposed between a bottom surface of the drawer and the slide when the slide is positioned to support the drawer, and the inclination control member is slidably moved in a direction toward the slide, so a distance between the bottom surface of the drawer and the slide is extended.

7. The slide attachment and detachment device of claim 2, further comprising a shock absorbing part formed to protrude from the coupling part and disposed between the end of the slide and the front part of the drawer when the slide is positioned to support the drawer.

8. The slide attachment and detachment device of claim 2, wherein the connecting part, the fixation support part, the elastic support part, and the lever part are made of a synthetic resin.

* * * * *